US006702179B2

(12) United States Patent
Chang

(10) Patent No.: US 6,702,179 B2
(45) Date of Patent: Mar. 9, 2004

(54) PAPERBOARD BOX

(76) Inventor: Shih-Jen Chang, 15 Chungtsun Street, Taichung City (TW)

( * ) Notice: Subject to any disclaimer, the term of this patent is extended or adjusted under 35 U.S.C. 154(b) by 50 days.

(21) Appl. No.: 10/005,995

(22) Filed: Dec. 4, 2001

(65) Prior Publication Data

US 2003/0102363 A1 Jun. 5, 2003

(51) Int. Cl.[7] ..... B65D 5/22; B65D 5/26

(52) U.S. Cl. ..... 229/106; 229/125.02; 229/125.08; 229/125.29; 229/128; 229/141; 229/193; 229/194

(58) Field of Search ..... 229/106, 112, 229/113, 114, 125.02, 125.08, 125.29, 128, 141, 190, 193, 194, 198, 902, 914

(56) References Cited

U.S. PATENT DOCUMENTS

| | | | | | |
|---|---|---|---|---|---|
| 242,262 | A | * | 5/1881 | Brown et al. | 229/194 |
| 267,624 | A | * | 11/1882 | Westervelt | 229/106 |
| 466,917 | A | * | 1/1892 | Blackmon | 229/193 |
| 665,731 | A | * | 1/1901 | Engberg | 229/198 |
| 1,352,833 | A | * | 9/1920 | Robinson | 229/125.29 |
| 1,425,256 | A | * | 8/1922 | Hickman et al. | 229/194 |
| 1,681,940 | A | * | 8/1928 | Lander | 229/193 |
| 2,072,753 | A | * | 3/1937 | Ikeda et al. | 229/113 |
| 2,152,911 | A | * | 4/1939 | Nemoede | 229/114 |
| 4,146,167 | A | * | 3/1979 | Pascus | 229/190 |
| 5,467,916 | A | * | 11/1995 | Beales | 229/125.29 |

FOREIGN PATENT DOCUMENTS

| | | | | |
|---|---|---|---|---|
| EP | 548879 A1 | * | 6/1993 | 229/125.29 |

* cited by examiner

*Primary Examiner*—Gary E. Elkins

(57) ABSTRACT

A paperboard box is made of a piece of paperboard with split lines and folding lines to form a shape like a boat so as to make the food or the like inside worthwhile and enhance the purchase desire of the consumer. Further, the paperboard box is easy to be disposed after using without creating a problem of contamination to the environment.

3 Claims, 13 Drawing Sheets

PAPERBOARD BOX

BACKGROUND OF THE INVENTION

1. Field of the Invention

The present invention relates to a paperboard box, and particularly, to a boat like box, which is made of a piece of paperboard providing split lines and folding lines to make the food or the like inside worthwhile and enhance the purchase desire of the consumer.

2. Description of Related Art

Conventionally, the plastic box is frequently used for containing food for sale but the plastic box usually is provided with a plain quadrilateral shape so that it is hard to allure purchase desire of the consumer. Moreover, it is hard for us to dispose or recycle the used plastic box so that it may cause a problem of contamination to the environment.

SUMMARY OF THE INVENTION

An object of the present invention is to provide a paperboard box, which is made of a piece of paperboard with split lines and folding lines, such that a boat like shape can be formed to make the food or the like inside worthwhile and enhance the purchase desire of the consumer.

Another object of the present invention is to provide a paperboard box, which is possible to be disposed easily and avoid contamination to the environment.

BRIEF DESCRIPTION OF THE DRAWINGS

The present invention can be more fully understood in the following description with reference to accompanying drawings, in which.

DETAILED DESCRIPTION OF THE PREFERRED EMBODIMENTS

Figure 1:
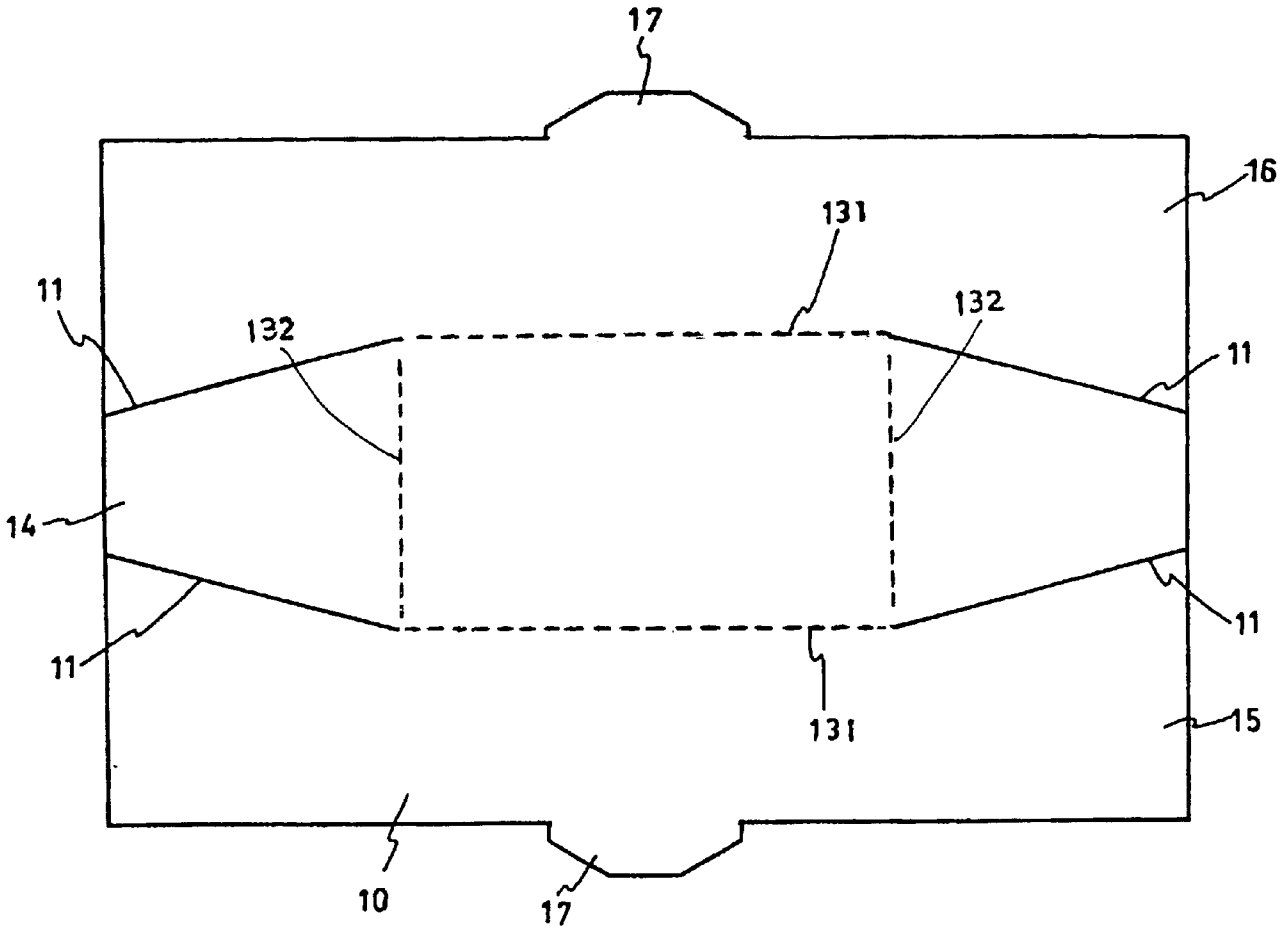
FIG. 1 is a developed view of a paperboard box according to the present invention in the first embodiment thereof.
Figure 2:
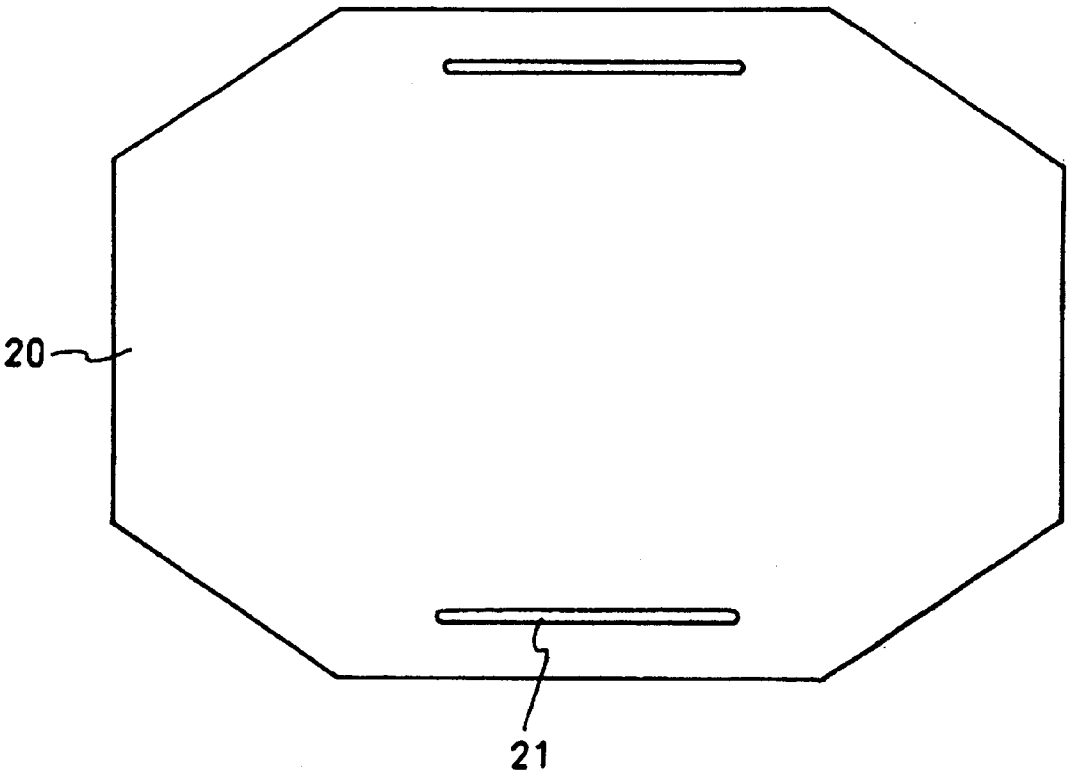
FIG. 2 is a plan view of an upper cover for the paperboard box shown in FIG. 1.

Referring to FIGS. 1, 2, 3 and 4, a paperboard box according to the present invention basically is a piece of paperboard 10 and the paperboard 10 provides two opposite folding lines 131 and another two opposite folding lines 132, which are vertical to the folding lines 131 in the middle area thereof to constitute the bottom of the paperboard box and the folding lines 131 each at both ends thereof provide a slant split line 11 extending outward to the right and the left side edges thereof respectively such that two opposite lower pieces 14 are formed with a trapezoid shape. Further, a first lateral piece 15 and a second lateral piece 16 are constituted next to the folding lines 131 and the slant split lines 11. The lateral pieces 15, 16 at the long outer edges thereof oppositely extend a locating ear 17 respectively as shown in FIG. 1. An upper cover 20 as shown in FIG. 2 is provided with a shape of polygon with two opposite slits 21 corresponding the two locating ears 17.

The paperboard 10 can be cut along the split lines 11 to separate the lower pieces 14 from the first lateral piece 15 and the second lateral piece 16 respectively while the paperboard box is in use. Then, the lateral pieces 15, 16 are folded up along the folding lines 131 and both ends of the first lateral piece 15 are crossly overlapped to both ends of the second lateral piece 16 respectively so that the lapped ends are fixedly joined to each other with glue or a staple.

Figure 3:
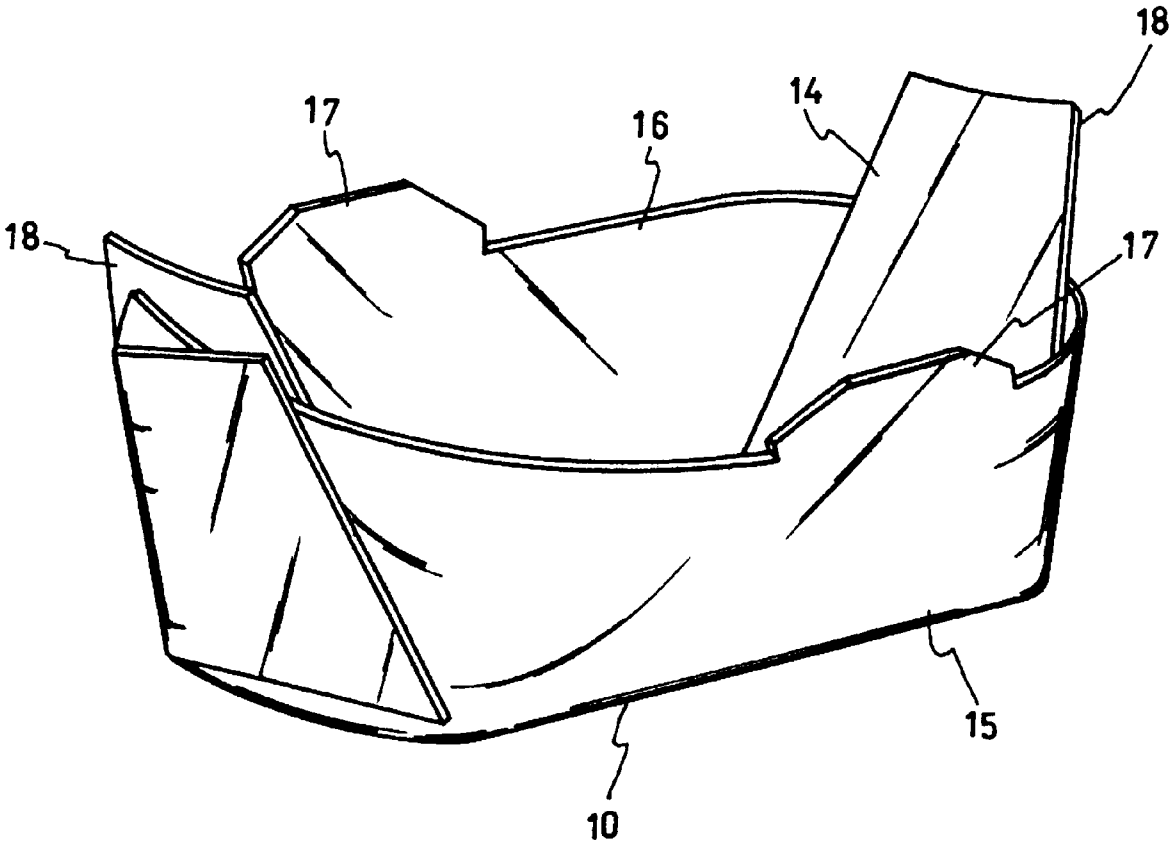
FIG. 3 is a perspective view of the paperboard box shown in FIG. 1.
Figure 4:
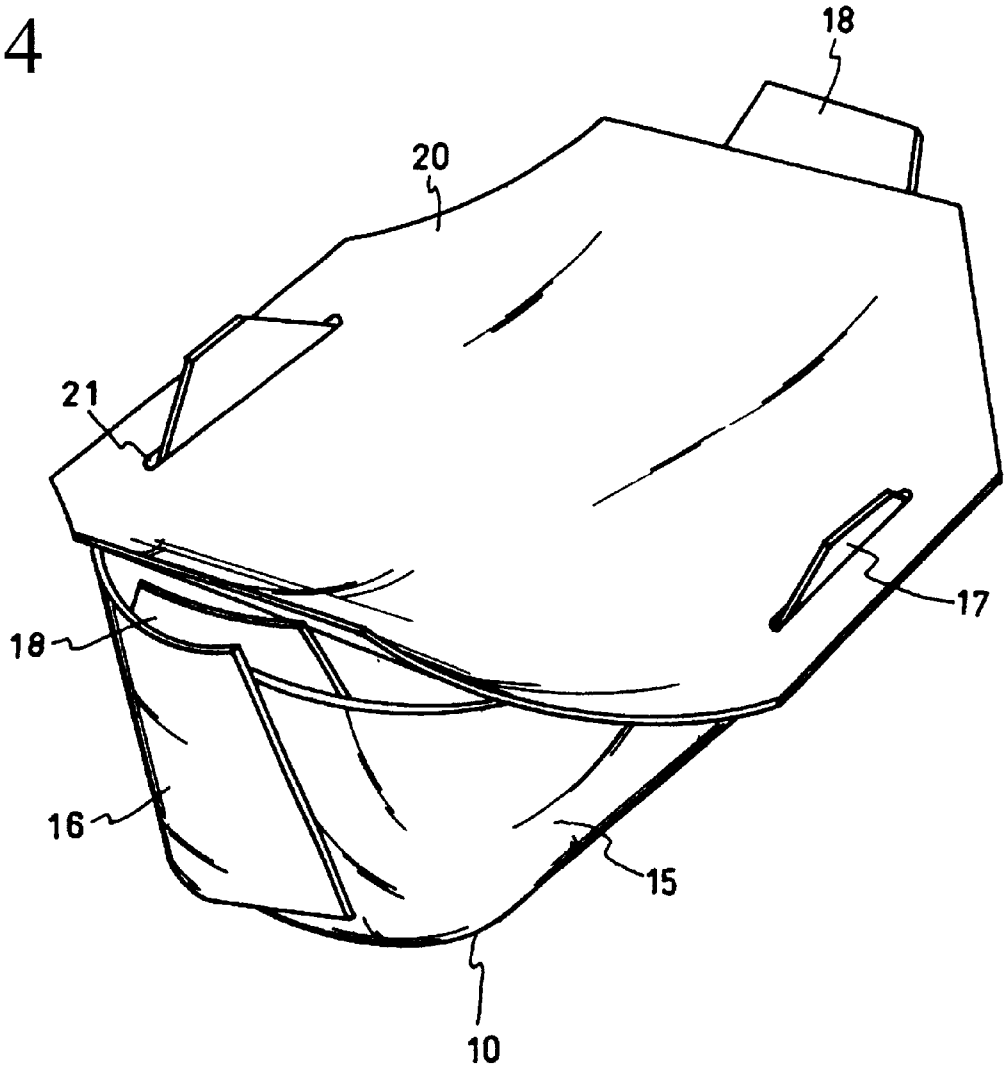
FIG. 4 is a perspective view of the paperboard box shown in FIG. 3 attached with the upper cover shown in FIG. 2.

Thus, the joined ends are disposed behind the lower pieces 14 to form a shape similar to both ends of a boat, that is, the paperboard 10 can be arranged to provide a boat like paperboard box as shown in FIG. 3 with the inner space thereof for receiving food such as little octopus balls or the like. Finally, the upper cover 20 can be affixed to the paperboard box in a way the slits 21 being pierced with the locating ears 17 on the paperboard 10 as shown in FIG. 4 so as to prevent the paperboard box from being entered by foreign substances. Further, it is possible for the paperboard to be piled up one after another.

Figure 5:
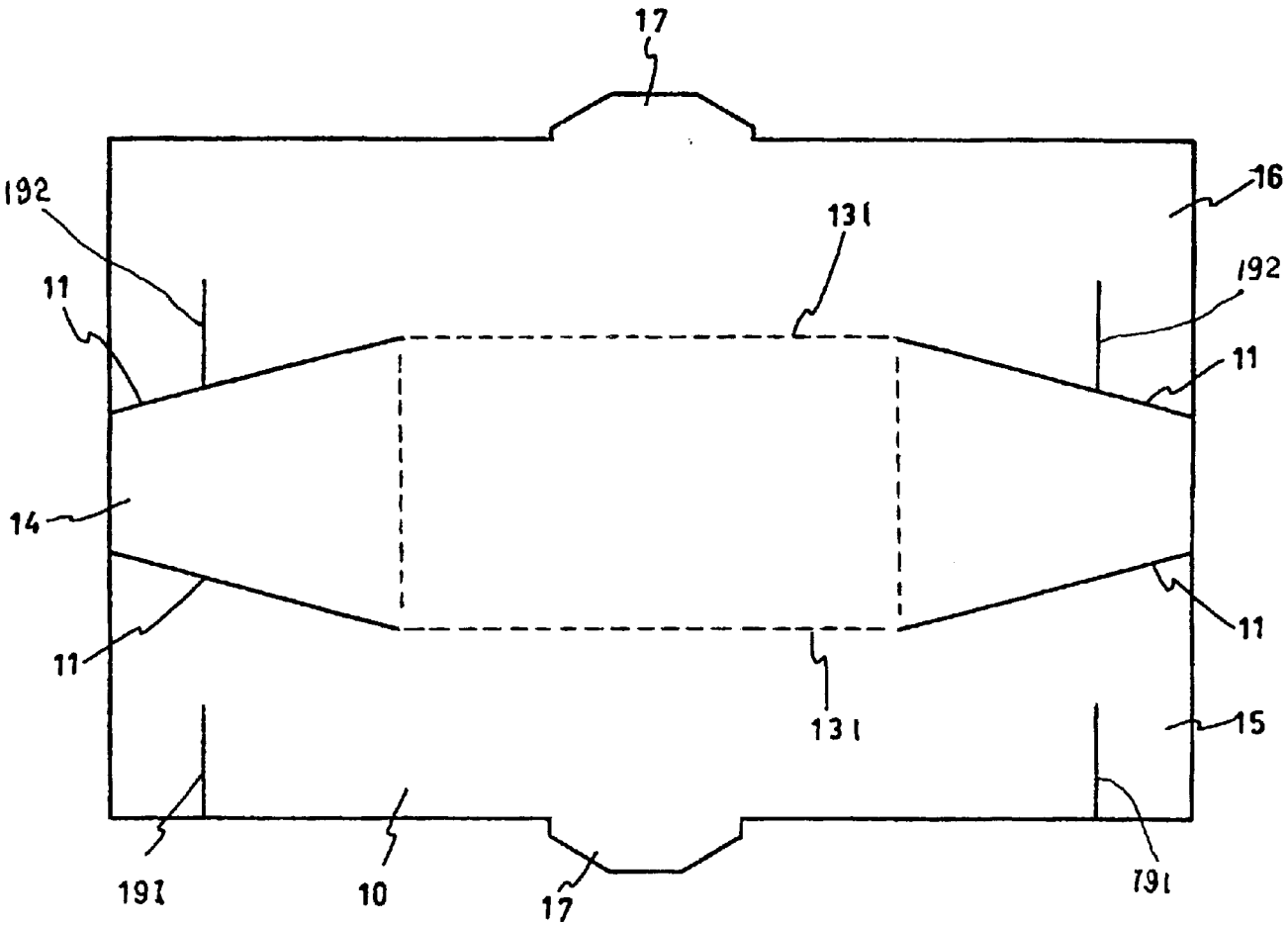
FIG. 5 is a developed view of a paperboard box according to the present invention in the second embodiment thereof.
Figure 6:
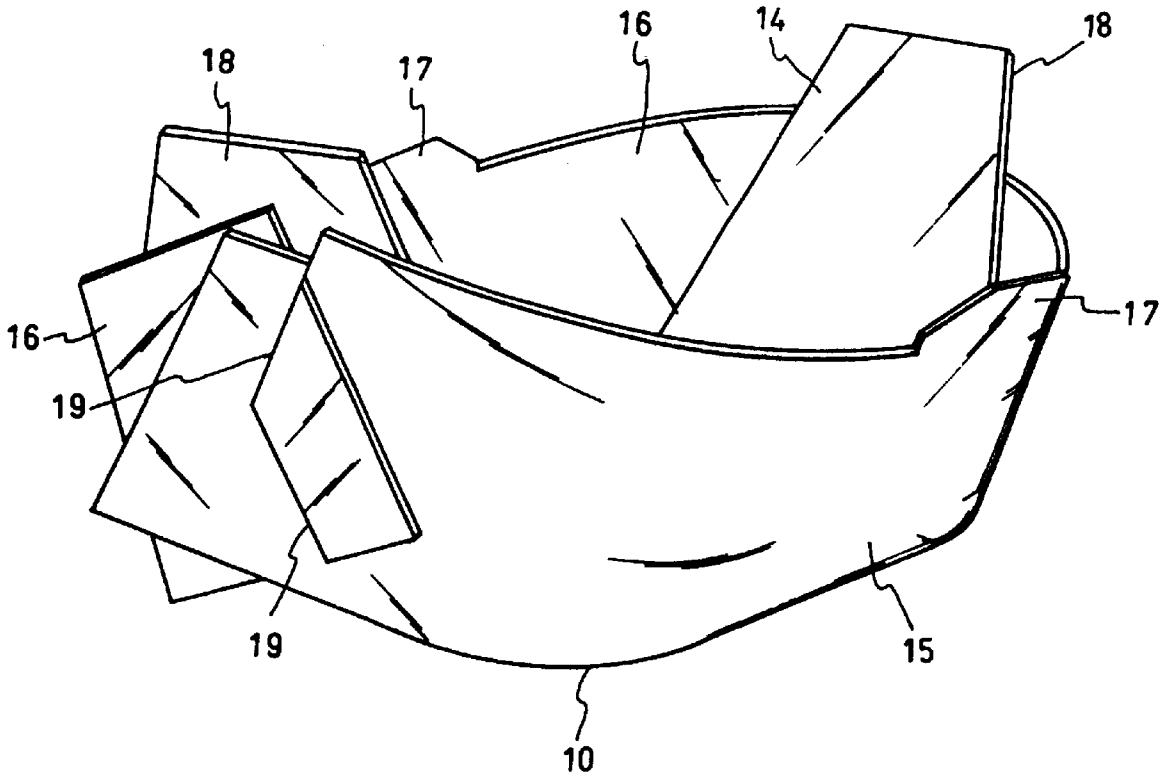
FIG. 6 is a perspective view of the paperboard box shown in FIG. 5;.

Referring to FIGS. 5, and 6, the second embodiment of the present invention is illustrated. The first lateral piece 15 at both ends thereof provides a further vertical split line 191 extending a distance from the long outer edge thereof respectively as shown in FIG. 5 and, similarly, the second lateral piece 16 at both end parts thereof provides a further vertical split line 192 extending a distance from the split edge 11 thereof to correspond to the vertical split lines 191 such that the lateral pieces 15, 16 at both end parts thereof can be interlocked to each other by way of the split lines 191, 192 being cut and engaging with each other as shown in FIG. 6. Hence, the paperboard 10 can form a paperboard box with two ends thereof like both ends of a boat.

Figure 7:
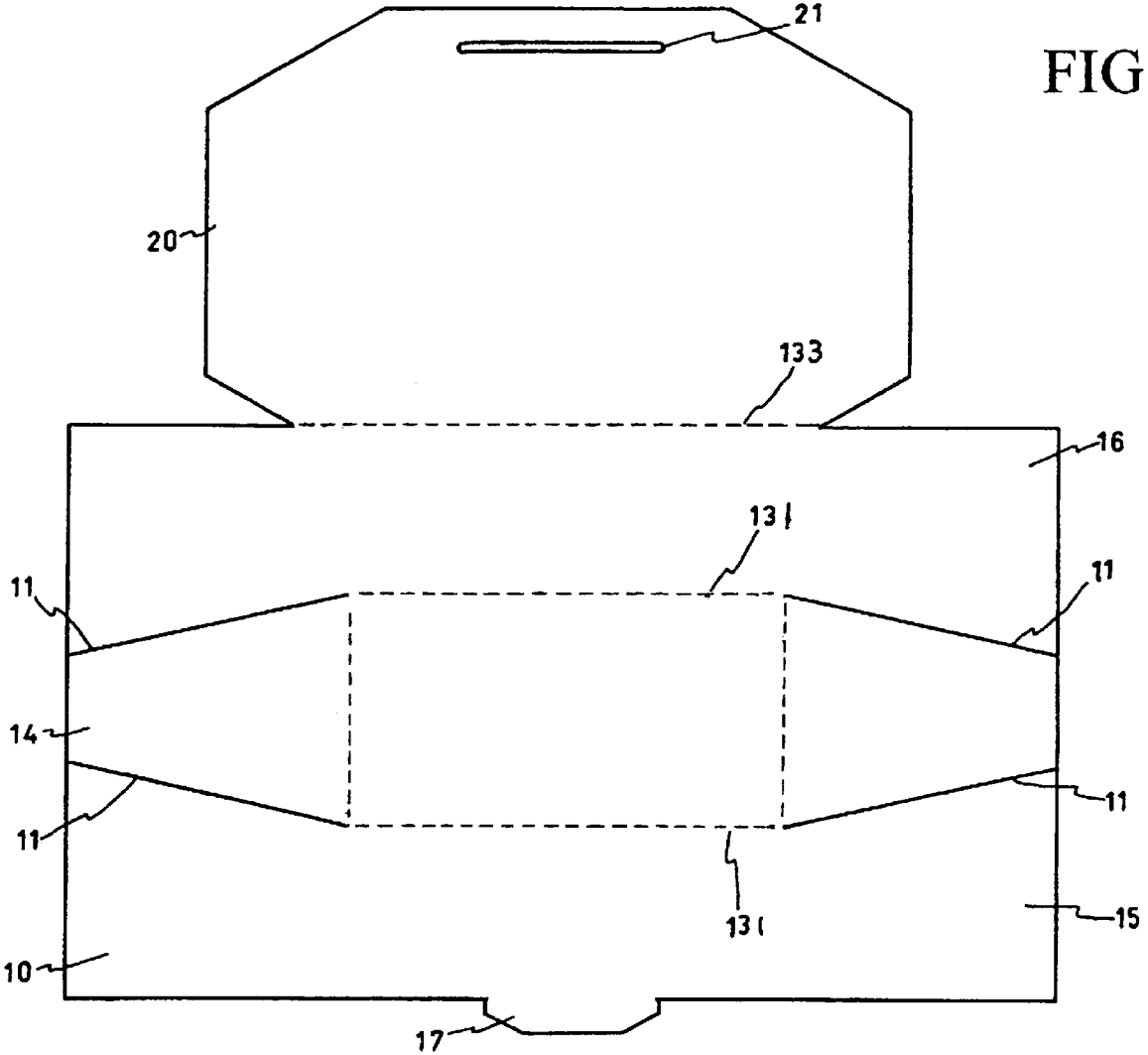
FIG. 7 is a developed view of a paperboard box according to the present invention in the third embodiment thereof.
Figure 8:
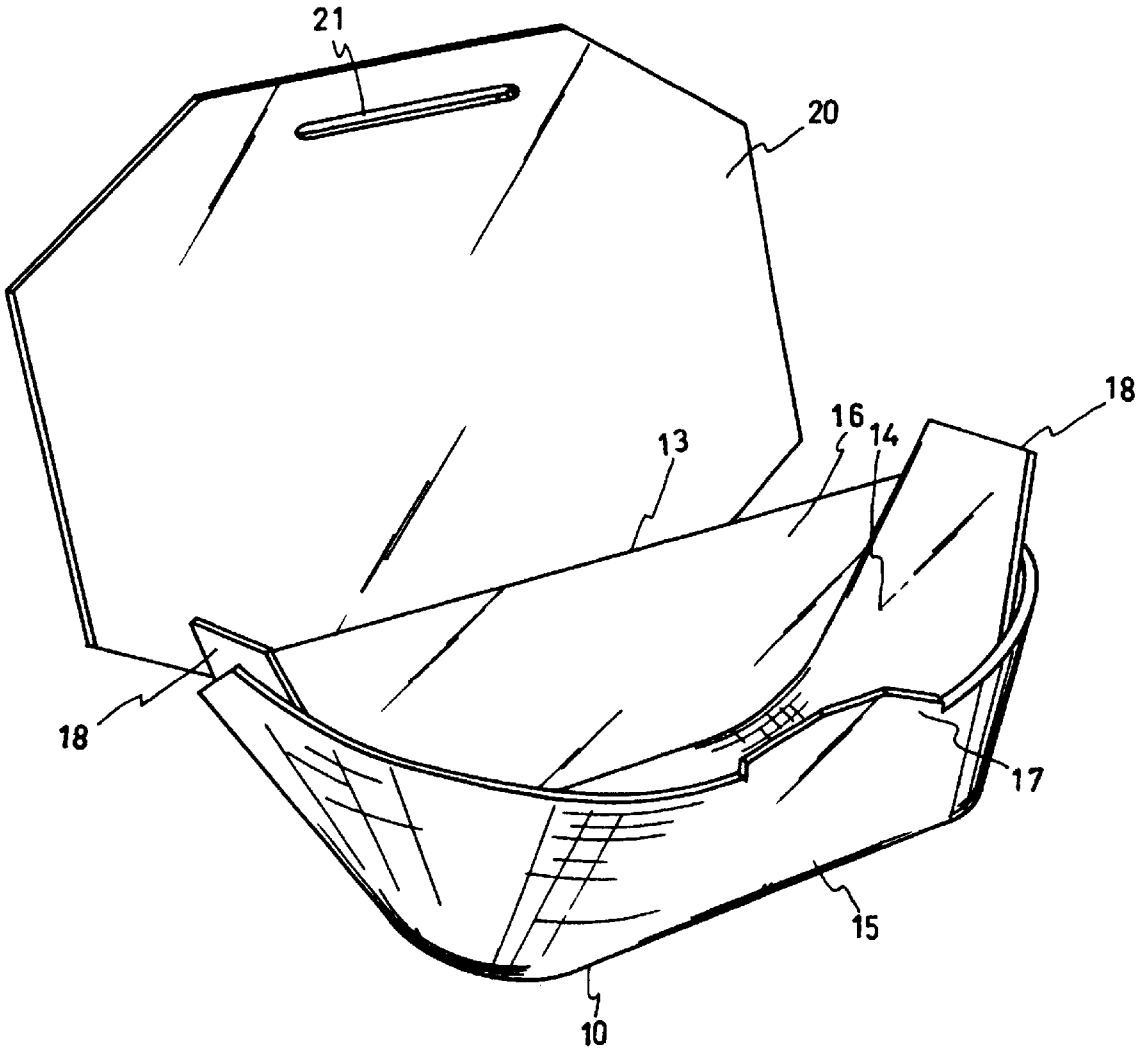
FIG. 8 is a perspective view of the paperboard box shown in FIG. 7.

Referring to FIGS. 7 and 8, the third embodiment of the present invention is illustrated. The second lateral piece 16 at the long outer edge thereof extends outward an upper cover 20 with a folding line 133 in between and a locating ear 17 extends outward from the first lateral piece 15 so as to pierce a slit 21 on the upper cover 20. Hence, a boat like paperboard box is formed as shown in FIG. 8. It is noted that the upper cover 20 can be arranged to extend from the first lateral piece 15 instead.

Figure 9:
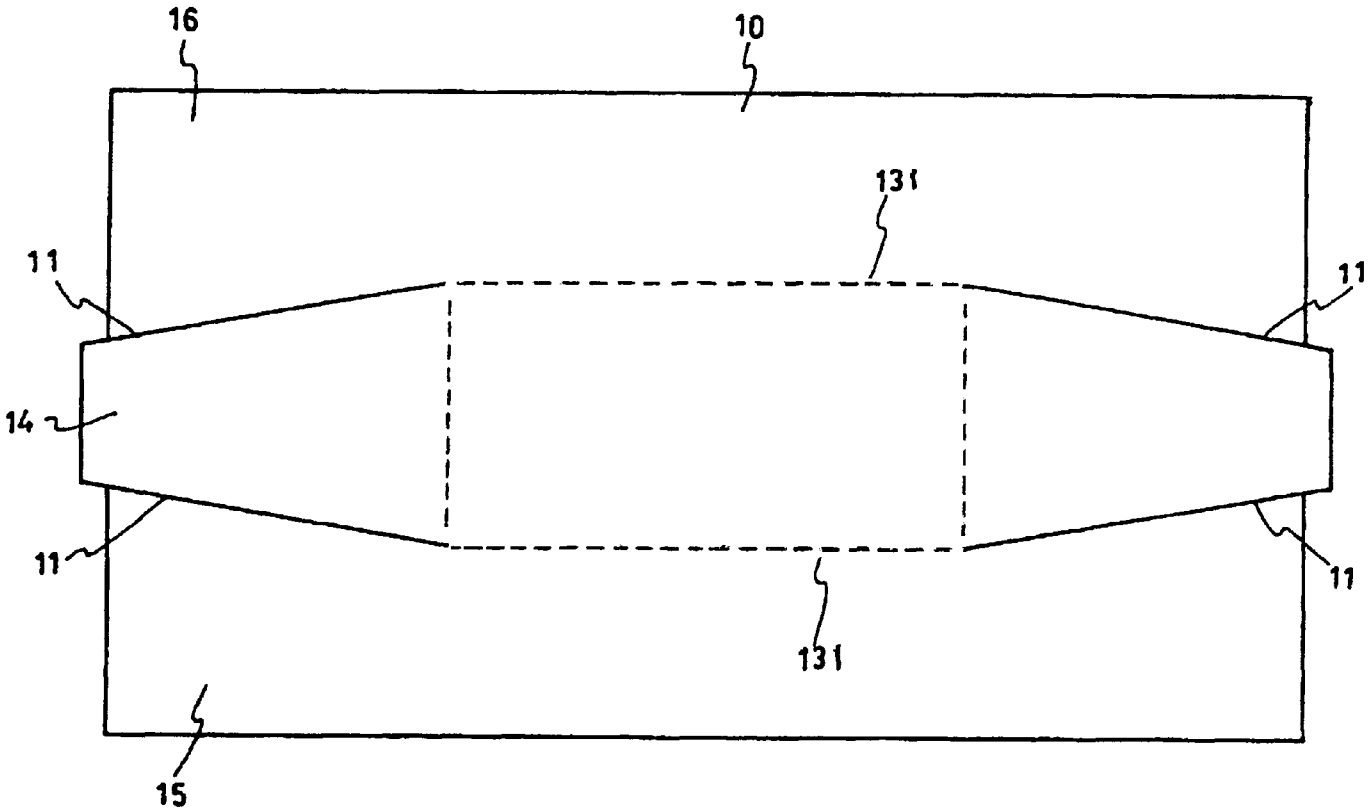
FIG. 9 is a developed view of a paperboard box according to the present invention in the fourth embodiment thereof.
Figure 10:
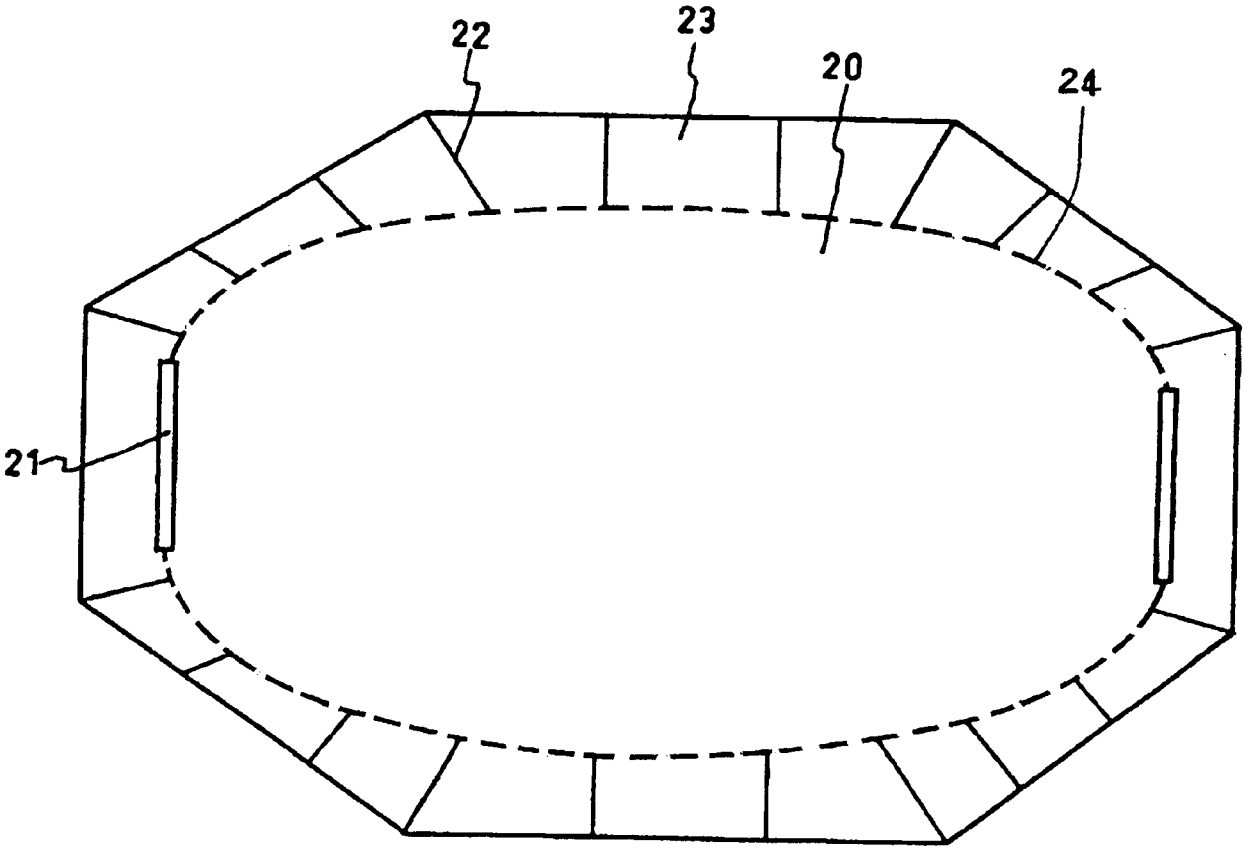
FIG. 10 is a plan view of an upper cover for the paperboard box shown in FIG. 9.
Figure 11:
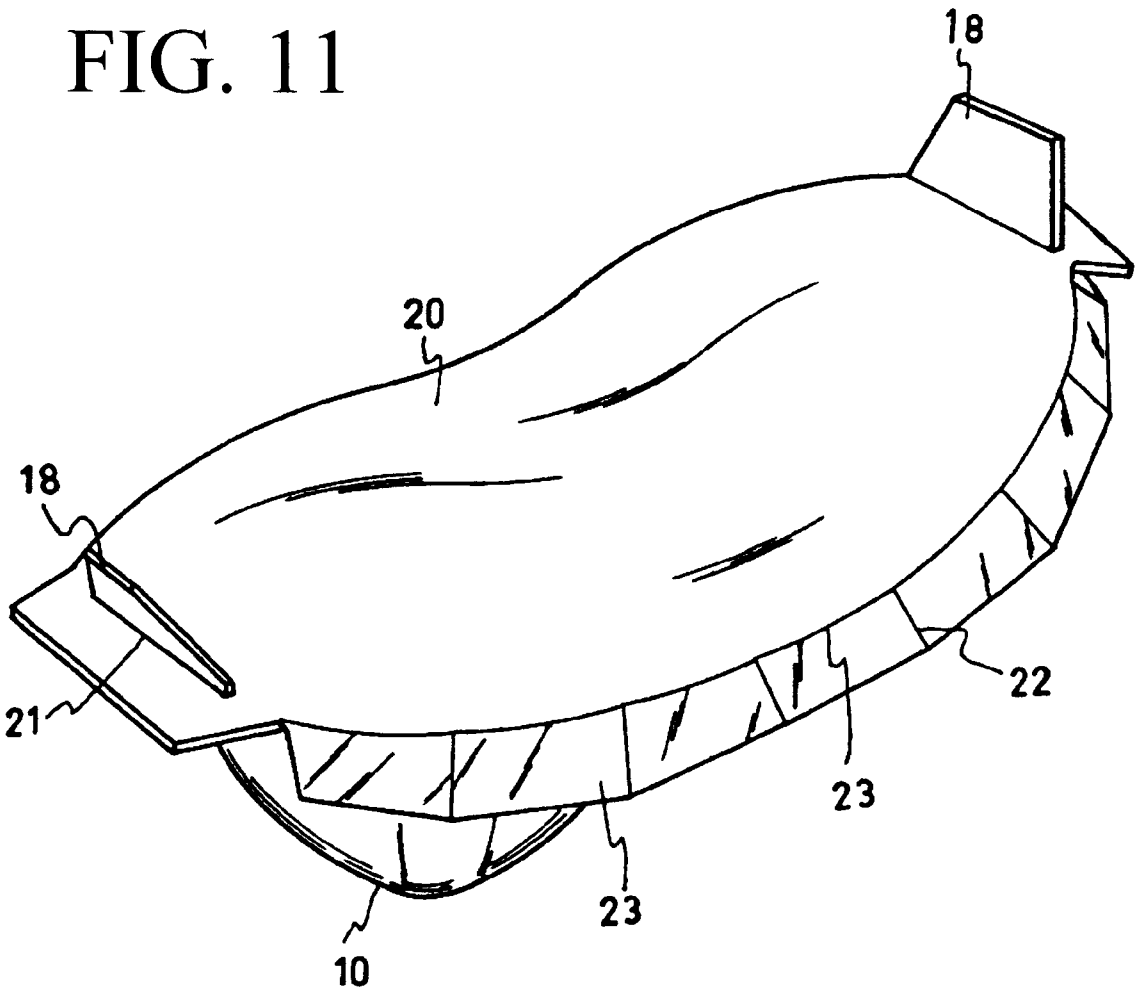
FIG. 11 is a perspective view of the paperboard box shown in FIG. 9 attached with the upper cover shown in FIG. 10.

Referring to FIGS. 9, 10 and 11, the fourth embodiment of the present invention is illustrated. No locating ears 17 are provided in FIG. 9 and both of the lower pieces 14 extend outward beyond the end parts of the lateral pieces 15, 16. The upper cover 20 provides a plurality of split lines 22 at the periphery thereof to constitute a plurality of flap pieces 23 and two opposite slits 21 are disposed next to two opposite large ones of the flap pieces 23 as shown in FIG. 10. The two lower pieces 14 at the outer ends 18 thereof can pierce the two slits 21 on the upper cover 20 and the flap pieces 23 are bent downward along the circular folding line 24 to enclose the paperboard box such that a further type of boat like.

Figure 12:
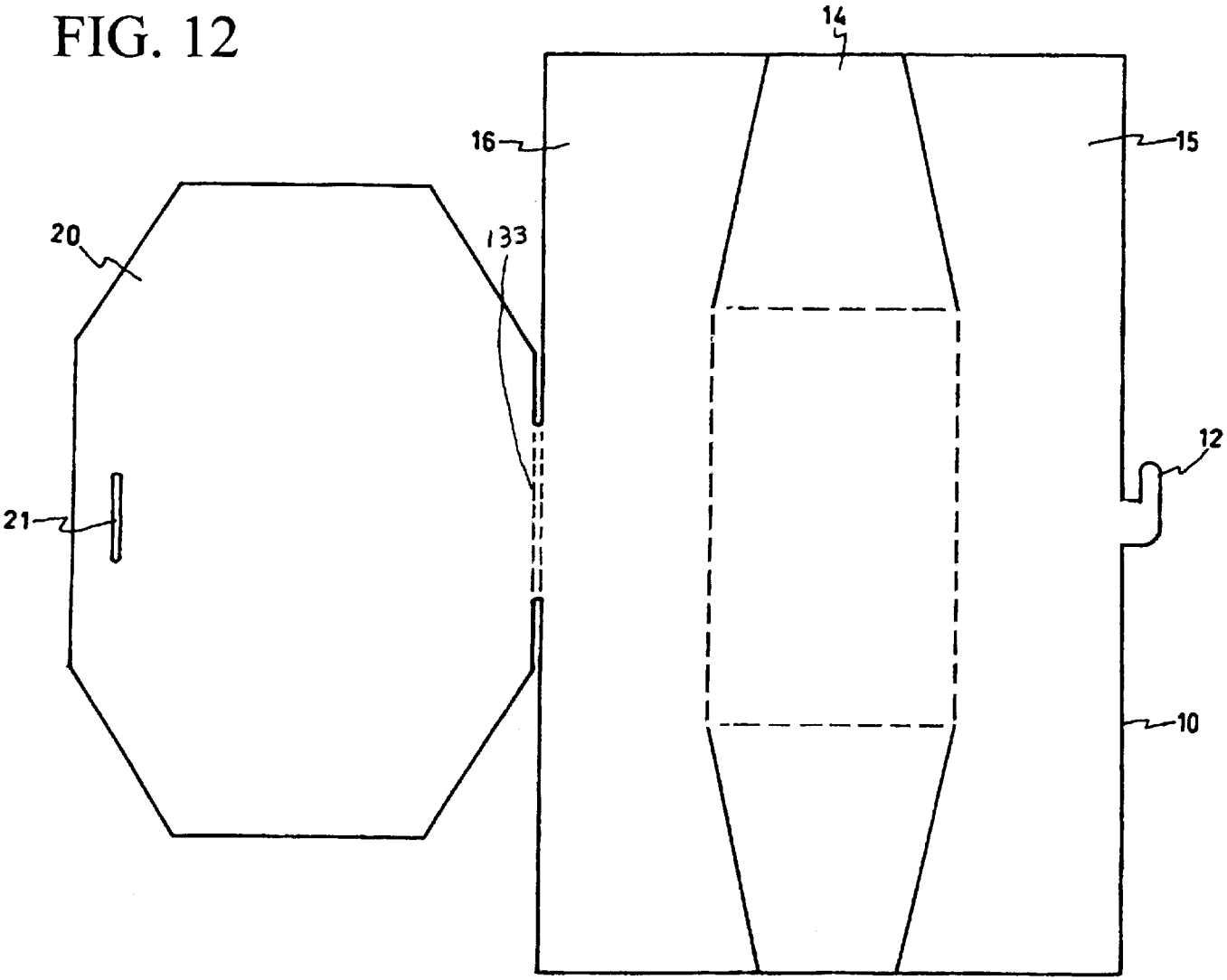
FIG. 12 is a developed view of a paperboard box according to the present invention in the fifth embodiment thereof.
Figure 13:
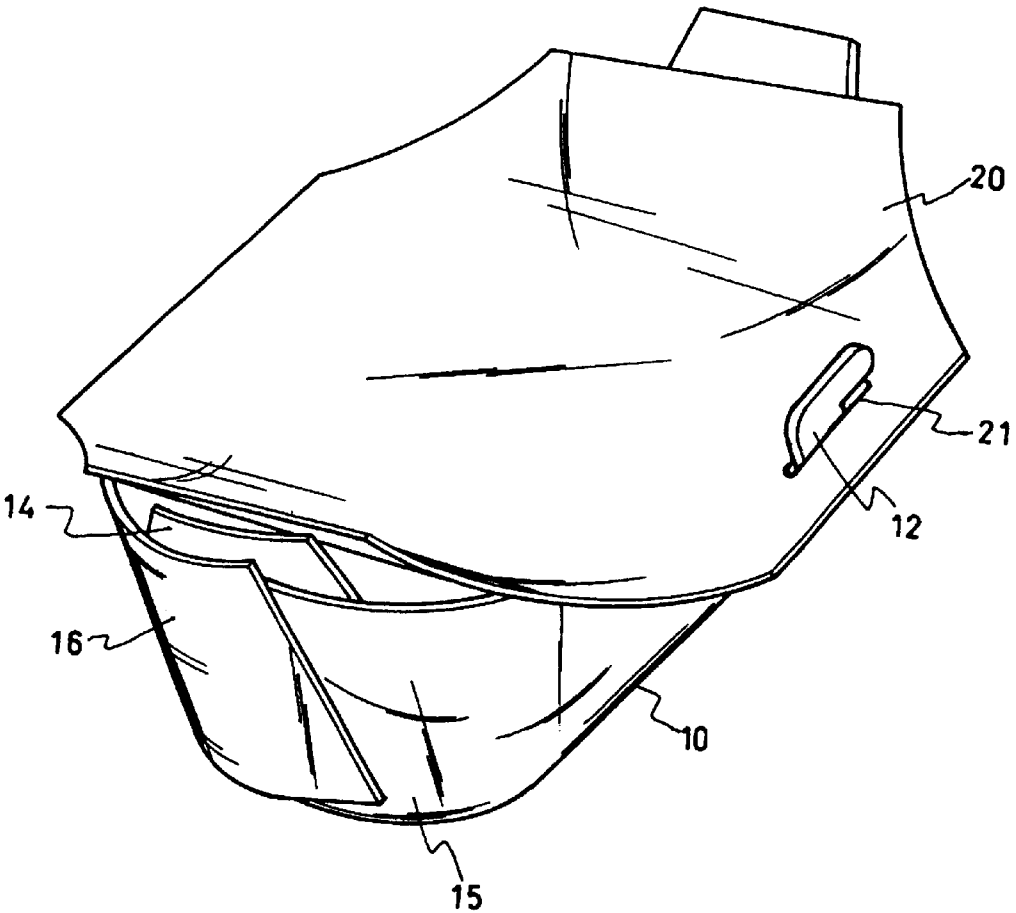
FIG. 13 is a perspective view of the paperboard box shown in FIG. 12.

Referring to FIGS. 12 and 13, the fifth embodiment of the present invention is illustrated. An upper cover 20 extends outward from the second lateral piece 16 and a L shaped hook ear 12 extends from the first lateral piece 15 corresponding to the slit 21 on the upper cover 20 so that the hook ear 12 can pierce the slit 21 to lock the upper cover 20. Hence, a further type of boat like paperboard box can be formed. It is noted that the upper cover 20 can be arranged to extend from the first lateral piece 15 and the L shaped hook ear 12 to extend from the second lateral piece 16 instead.

It is appreciated from the foregoing that the paperboard box of the present invent ion offers the following advantages 1. A boat like paperboard box can be made of a piece of paperboard, which provides several split lines and folding lines so as to form folded parts for being overlapped each other. The boat like paperboard box presents a lovely configuration to make food such as the little octopus balls inside the box worthwhile and enhance the purchase desire of the consumer. Further, the paperboard box of the present invention can solve the problem of contamination to the environment.
2. The paperboard box of the present invention provides two lateral pieces with end parts of the lateral pieces being crossly overlapped and joined to each other such that the locating ears thereof can obtain outward expanding forces to retain the upper cover firmly.
3. The paperboard box of the present invention can be provided with different types of combinations such as the box with a separate upper cover, the box without any upper cover and the box being integral with an upper cover part to meet different needs of the consumers.

While the invention has been described with reference to preferred embodiments, it is to be understood that modifications and variations may be easily made without departing from the spirit of this invention defined by the appended claims.

What is claimed is:

1. A paperboard box made of a piece of paperboard, comprising:

a bottom with two opposite ends and two lateral sides, being a middle area of the paperboard;

two folded lower pieces, extending from the two ends of the bottom respectively; and two folded lateral pieces, being disposed at the two lateral sides of the bottom respectively and each of the lateral pieces having two end parts beside the lower pieces with a respective slant split in-between;

characterized in that one of the lateral pieces at the end parts thereof has a respective first vertical split extending a distance from an inner side edge thereof and the other one of the lateral pieces at the end parts thereof has a respective second vertical split extending a distance from an outer side edge thereof corresponding to the first vertical splits such that the two lateral pieces at the end parts thereof can be crossly interlocked to each other behind the lower pieces so as to form two ends of the paperboard box like both ends of a boat.

2. The paperboard box as defined in claim 1, further includes an upper cover, wherein the upper cover comprises:

a periphery of elongated polygon with two opposite short sides, being provided with a plurality of flap pieces, which are bent downward along a circular fold line; and two slits, being oppositely disposed next to two large opposite ones of the flap pieces for being passed through by the lower pieces.

3. A paperboard box made of a piece of paperboard, comprising:

a bottom with two opposite ends and two lateral sides, being a middle area of the paperboard;

two folded lower pieces, extending from the two ends of the bottom respectively;

two folded lateral pieces, being disposed at the two lateral sides of the bottom respectively and each of the lateral pieces having two end parts beside the lower pieces with a respective slant split in-between; and an upper cover with a slit, extending from one of the lateral pieces;

characterized in that one of the lateral pieces at the end parts thereof has a respective first vertical split extending a distance from an inner side edge thereof and the other one of the lateral pieces at the end parts thereof has a respective second vertical split extending a distance from an outer side edge thereof corresponding to the first vertical splits such that the two lateral pieces at the end parts thereof can be crossly interlocked to each other behind the lower pieces so as to form two ends of the paperboard box like both ends of a boat; and a L-shaped ear is provided at the other one of the lateral pieces corresponding to the slit for retain the upper cover in place.

* * * * *